US009505112B1

(12) United States Patent
Huang

(10) Patent No.: US 9,505,112 B1
(45) Date of Patent: Nov. 29, 2016

(54) PIN PULLER

(71) Applicant: GU SIANG TOOLS DEVELOP CO., LTD., Chiayi County (TW)

(72) Inventor: Sheng-Pin Huang, Chiayi County (TW)

(73) Assignee: Gu Siant Tools Develop Co., Ltd., Chiayi County (TW)

( * ) Notice: Subject to any disclaimer, the term of this patent is extended or adjusted under 35 U.S.C. 154(b) by 29 days.

(21) Appl. No.: 14/791,616

(22) Filed: Jul. 6, 2015

(51) Int. Cl.
*B25B 27/02* (2006.01)

(52) U.S. Cl.
CPC ..... *B25B 27/02* (2013.01); *Y10T 403/7005* (2015.01)

(58) Field of Classification Search
CPC ..... B25B 27/02; Y10T 403/7005
USPC ..... 403/348, 341, 365, 375, 344; 29/244
See application file for complete search history.

(56) References Cited

U.S. PATENT DOCUMENTS 2,158,433 A * 5/1939 Schultz ..... B25B 27/026 29/252
2,596,549 A * 5/1952 Hamilton ..... B25B 27/062 29/263
3,110,958 A * 11/1963 McCord ..... B25B 27/062 29/263
3,358,352 A * 12/1967 Wilcox ..... B25B 27/062 29/254
4,684,156 A * 8/1987 Rhodes ..... F16L 37/138 285/27
5,967,691 A * 10/1999 Lancelot, III ..... E04C 5/165 403/296
8,011,848 B2 * 9/2011 Sockman ..... A46D 3/08 403/325
8,627,557 B2 1/2014 Jansen et al.
2011/0010909 A1 * 1/2011 Jansen ..... B25B 27/023 29/426.5

* cited by examiner

*Primary Examiner* — Joseph J Hail
*Assistant Examiner* — J Stephen Taylor
(74) *Attorney, Agent, or Firm* — Rosenberg, Klein & Lee

(57) ABSTRACT

A pin puller is revealed. The pin puller includes a cylinder mounted with an actuating rod therein. A front end of the actuating rod is connected to and fixed on a pin connection unit. The pin connection unit is fitted over and connected to one end part of a positioning pin while a binding sleeve is disposed around the pin connection unit. The other end part of the positioning pin is mounted and connected to a fixing unit for pin-disassembling or a fixing unit for pin-assembling for driving the cylinder to move the actuating rod. The positioning pin is further pulled to be disassembled or assembled by the pin connection unit. Thereby the pin puller has simpler structure. Thus the manufacturing cost is lowered and the pin puller is having simpler structure and more convenient in operation and use.

8 Claims, 9 Drawing Sheets

PIN PULLER

BACKGROUND OF THE INVENTION

Field of the Invention

The present invention relates to a pin puller, especially to a pin puller with simpler structure, reduced production cost, and convenient operation and use. The present design of the pin puller is more practical.

Descriptions of Related Art

A leaf spring used for suspension in vehicles is assembled and positioned by positioning pins. The positioning pins are assembled and disassembled by a pin puller. Refer to U.S. Pat. No. 8,627,557 B2 published on Jan. 14, 2014, a pin puller is revealed. The pin puller includes a pull rod fixed with the pin. Then a cylinder is used to control the pull rod for assembling or disassembling the pin.

Although the pin puller mentioned above provides the expected functions, the device has the following disadvantages while in use:

1. The device includes multiple components and having complicated structure. Thus the device is not convenient to operate and use.
2. The pull rod and the cylinder are separated from each other. While in use, the pull rod is mounted and fixed in the cylinder. Then the cylinder is used to drive the pull rod to act. This also causes considerable inconvenience in the operation and use of the pin puller.

SUMMARY OF THE INVENTION

Therefore it is a primary object of the present invention to provide a pin puller that has simpler structure, reduced manufacturing cost, and convenience in operation and use.

In order to achieve the above object, a pin puller according to the present invention includes a cylinder, a support member, a pin connection unit, and a fixing unit for pin-disassembling.

The cylinder is mounted with an actuating rod therein and is disposed with a support base that is connected to a front end of the cylinder and fitted over the actuating rod.

The support member is mounted and connected to the support base of the cylinder. The support member is disposed with a support ring. An auxiliary support sleeve is arranged between the support ring and the support base. The auxiliary support sleeve is first mounted to the front end of the support base. Then the support ring is mounted to the front end of the auxiliary support sleeve.

The pin connection unit is connected to and fixed on the front end of the actuating rod of the cylinder. The pin connection unit is also fitted over and connected to an end part of a positioning pin. A positioning block is pivotally connected to the pin connection unit and corresponding to a groove concavely disposed around the end part of the positioning pin. A binding sleeve is movably fitted over the actuating rod of the cylinder. The binding sleeve is also disposed around the pin connection unit.

The fixing unit for pin-disassembling has an outer diameter that is smaller than an outer diameter of the positioning pin. The fixing unit for pin-disassembling is mounted with and connected to the other end part of the positioning pin. A positioning block corresponding to a groove concavely disposed around the other end part of the positioning pin is movably and pivotally connected to the fixing unit for pin-disassembling. Thus the positioning block of the fixing unit for pin-disassembling is locked in the groove on the other end part of the positioning pin.

While assembling the positioning pin, a pin puller is used. The pin puller according to the present invention has a structure similar to the above one, including a cylinder, a support member, and a pin connection unit. The support member is mounted and connected to the support base of the cylinder. The support member is arranged with a support ring while the support ring is directly mounted to the front end of the support base.

Moreover, the pin puller includes a fixing unit for pin-assembling whose outer diameter is larger than an outer diameter of the positioning pin. The fixing unit for pin-assembling is fitted over and connected to the other end part of the positioning pin. A positioning block corresponding to a groove concavely around the other end part of the positioning pin is movably and pivotally connected to the fixing unit for pin-assembling. The positioning block of the fixing unit for pin-assembling is locked into the groove on the other end part of the positioning pin.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
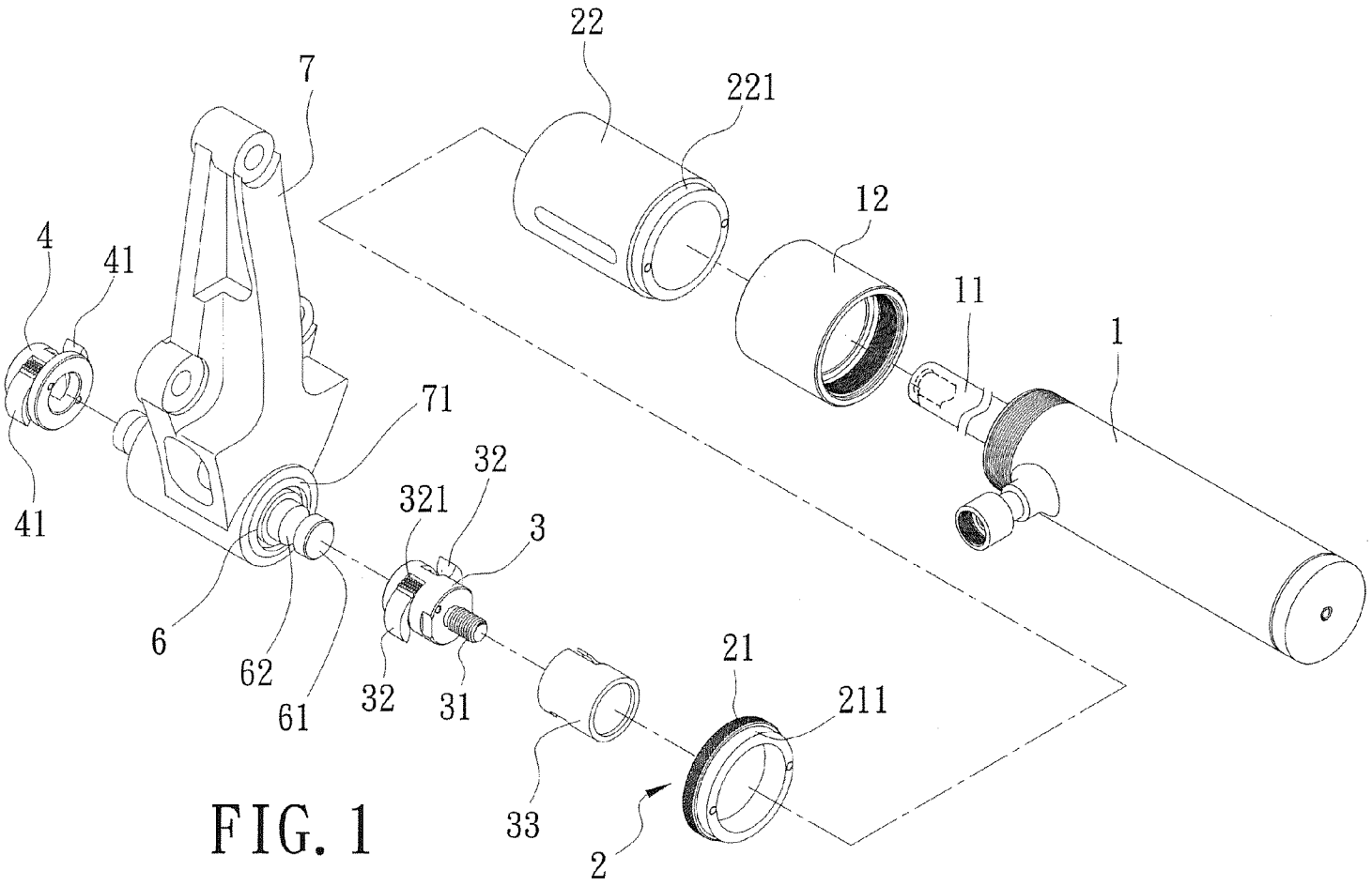
FIG. 1 is an explosive view of an embodiment according to the present invention.
Figure 2:
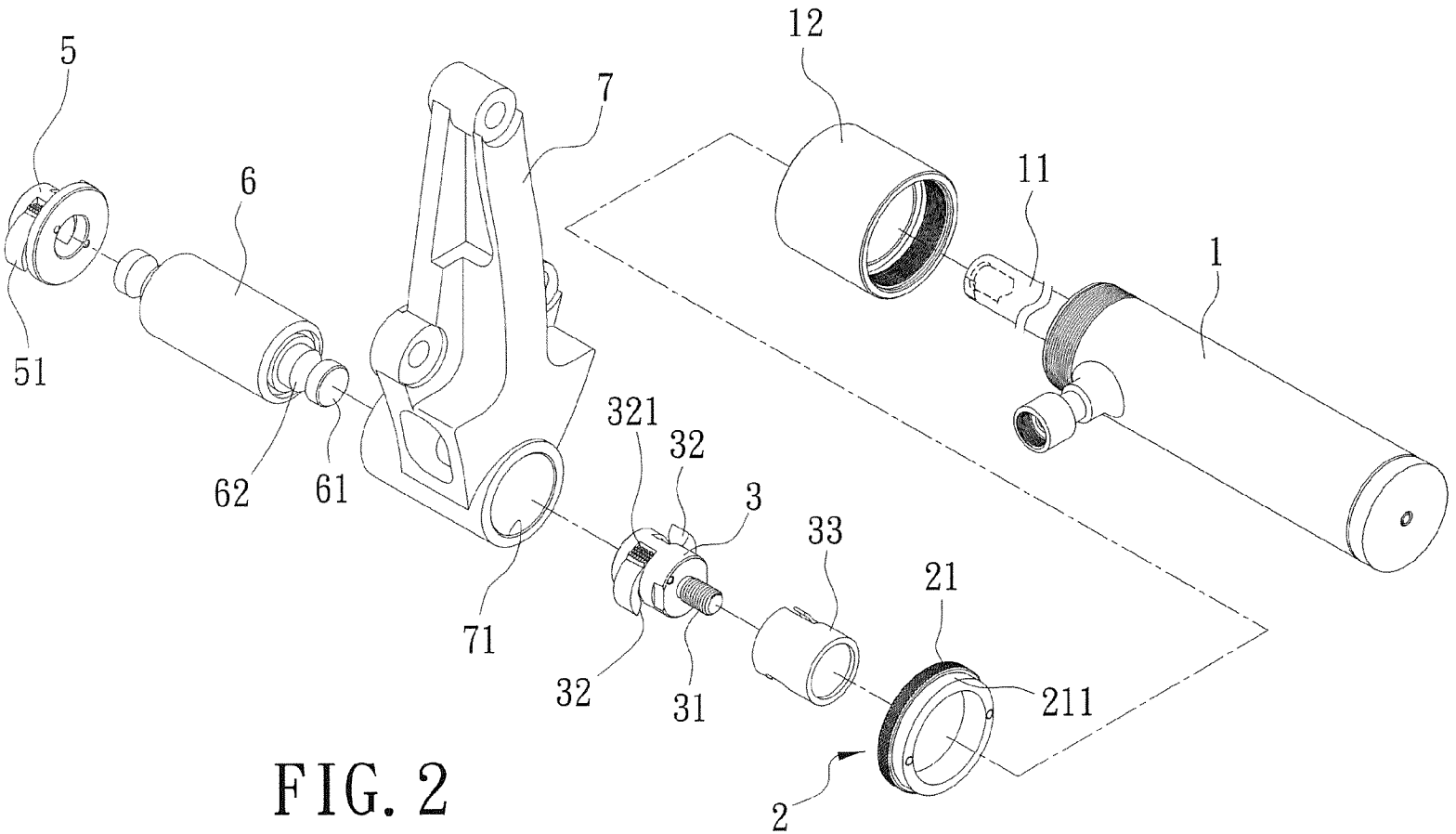
FIG. 2 is another explosive view of an embodiment according to the present invention.

Refer to FIG. 1 and FIG. 2, a pin puller of the present invention includes a cylinder 1, a support member 2, a pin connection unit 3, a fixing unit for pin-disassembling 4 and a fixing unit for pin-assembling 5.

The cylinder 1 includes an actuating rod 11 mounted therein and a support base 12 connected to a front end of the cylinder 1 and fitted over the actuating rod 11.

The support member 2 is mounted and connected to the support base 12 of the cylinder 1. The support member 2 is arranged with a support ring 21. A stepped edge 211 is formed on one end of the support ring 21. Thus the support ring 21 is able to be directly mounted to the front end of the support base 12 by the stepped edge 211. Or the support member 2 further includes an auxiliary support sleeve 22 set between the support ring 21 and the support base 12. A stepped edge 221 is formed on one end of the auxiliary support sleeve 22. The auxiliary support sleeve 22 is first mounted to the front end of the support base 12 by the stepped edge 221. Then the support ring 21 is mounted to the front end of the auxiliary support sleeve 22 by the stepped edge 211.

Figure 3:
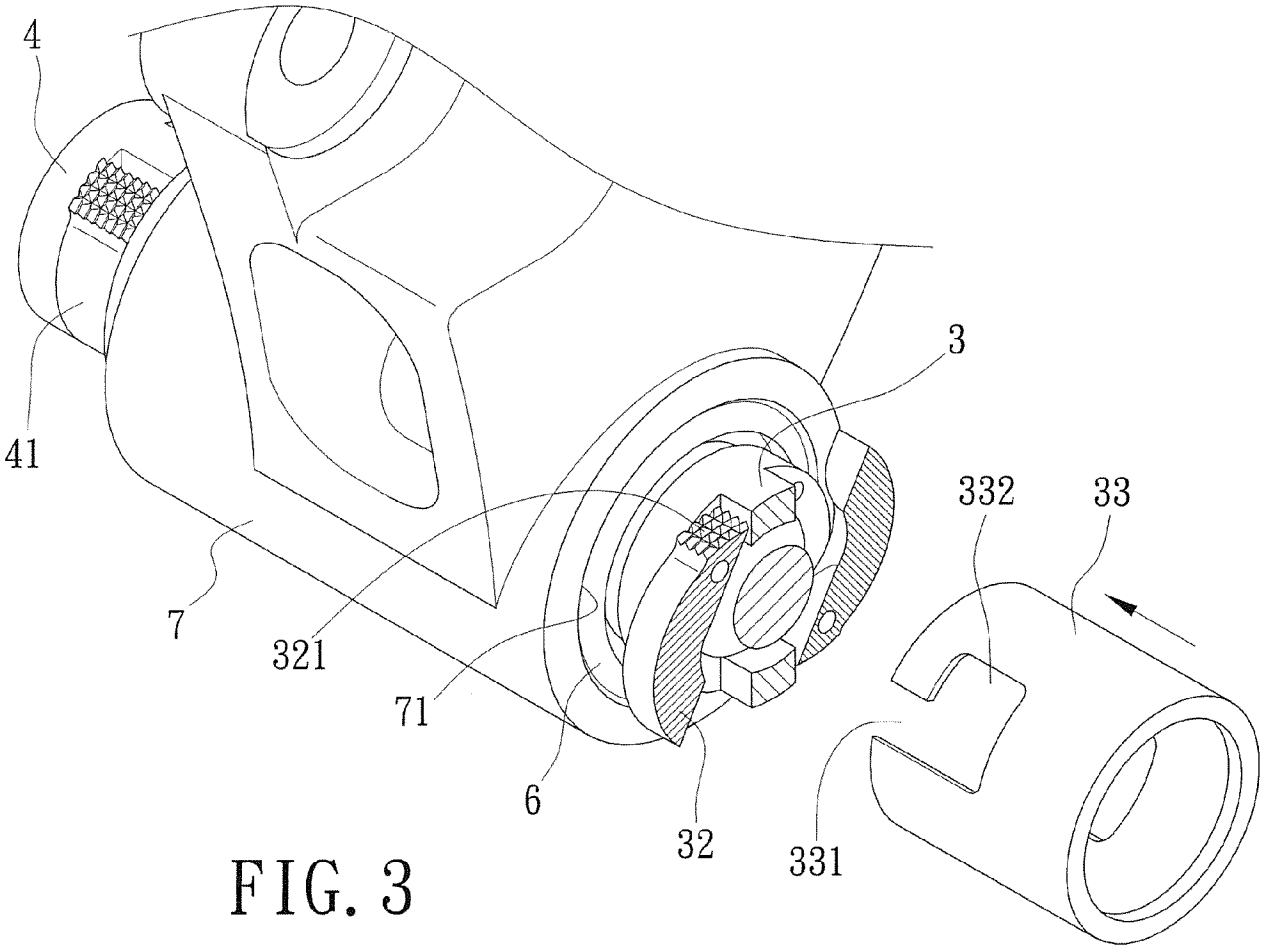
FIG. 3 is enlarged partial perspective view of a longitudinal section of an exploded embodiment according to the present invention.
Figure 4:
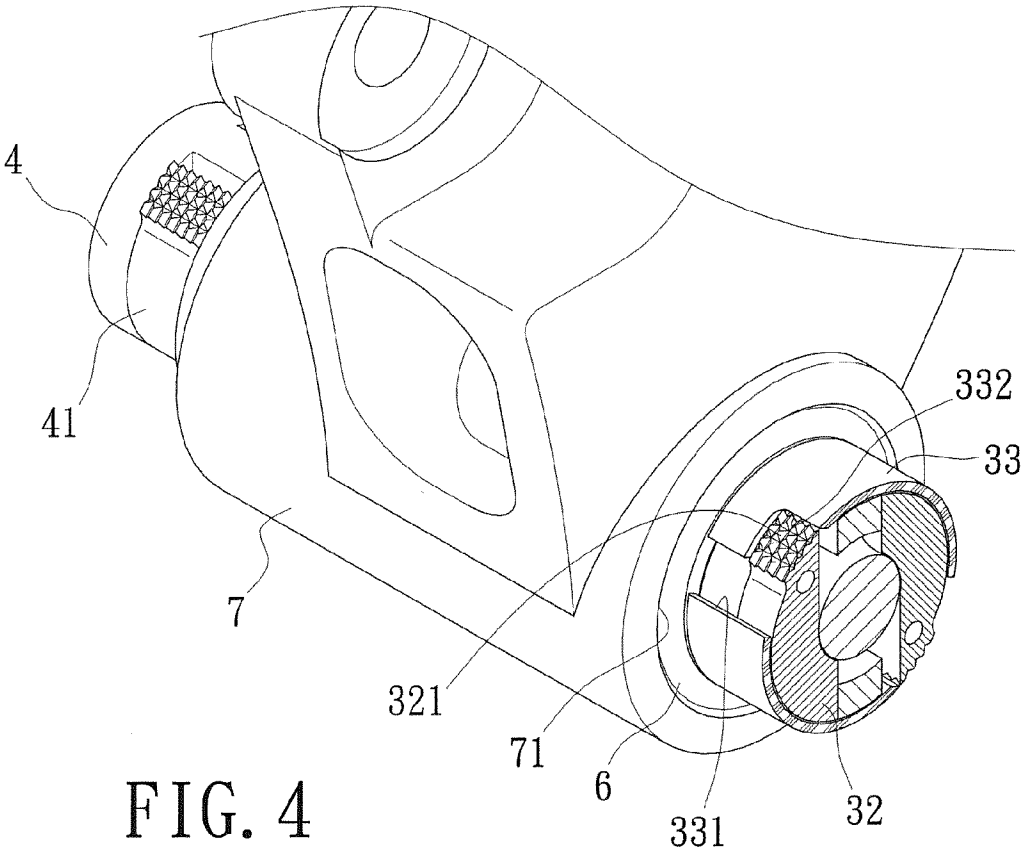
FIG. 4 is enlarged partial perspective view of a longitudinal section of an assembled embodiment according to the present invention.

Refer to FIG. 1, FIG. 2 and FIG. 3, the pin connection unit 3 consists of a threaded part 31, a positioning block 32, and a binding sleeve 33. The threaded part 31 is connected to and fixed on the front end of the actuating rod 11 of the cylinder 1. The pin connection unit 3 is fitted over and connected to an end part 61 of a positioning pin 6. The positioning block 32 is pivotally connected to the pin connection unit 3 and is corresponding to a groove 62 that is concavely disposed around the end part 61 of the positioning pin 6. Thus the positioning block 32 can be locked in the groove 62 on the end part 61 of the positioning pin 6. A positioning protrusion 321 is projecting from surface of the positioning block 32. The binding sleeve 33 is movably fitted over the actuating rod 11 of the cylinder 1. The binding sleeve 33 is also disposed around the pin connection unit 3. Refer to FIG. 3, a guiding slot 331 corresponding to the positioning protrusion 321 of the positioning block 32 is formed on the binding sleeve 33 and a positioning slot 332 is formed on the rear end of the guiding slot 331. By the guiding slot 331 of the binding sleeve 33 aligned with the positioning protrusion 321 of the positioning block 32, the pin connection unit 3 are mounted and connected to the binding sleeve 33. Then the binding sleeve 33 is rotated so that the positioning protrusion 321 is moved into the positioning slot 332 to be positioned, as shown in FIG. 4.

Refer to FIG. 1 and FIG. 3, the fixing unit for pin-disassembling 4 has an outer diameter that is smaller than an outer diameter of the positioning pin 6. The fixing unit for pin-disassembling 4 is mounted with and connected to the other end part 61 of the positioning pin 6. A positioning block 41 is movably and pivotally connected to the fixing unit for pin-disassembling 4 and is located corresponding to a groove 62 that is concavely disposed around the other end part 61 of the positioning pin 6. Thus the positioning block 41 can be locked in the groove 62 on the end part 61 of the positioning pin 6.

Figure 8:
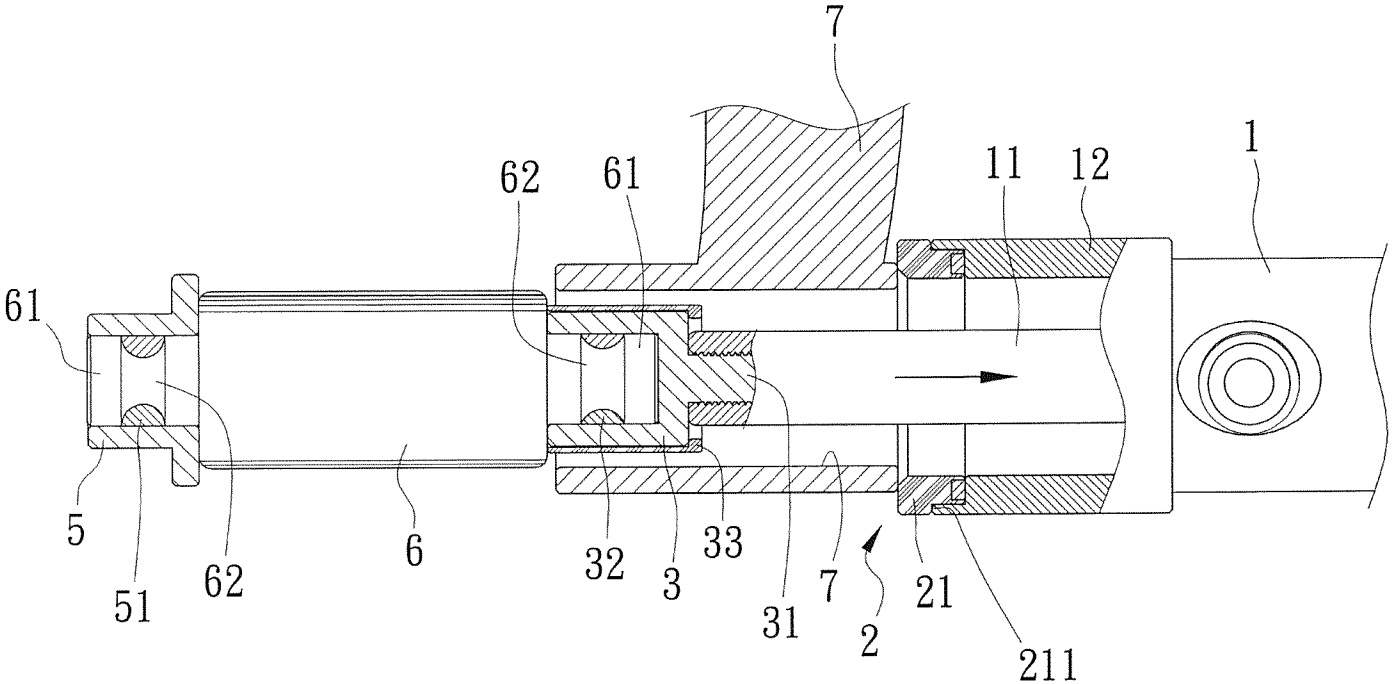
FIG. 8 is a longitudinal sectional view of a positioning pin being moved and assembled of an embodiment according to the present invention.

Refer to FIG. 2 and FIG. 8, the fixing unit for pin-assembling 5 has an outer diameter that is larger than an outer diameter of the positioning pin 6. The fixing unit for pin-assembling 5 is fitted over and connected to the other end part 61 of the positioning pin 6. A positioning block 51 is movably and pivotally connected to the fixing unit for pin-assembling 5 and is located corresponding to a groove 62 which is concavely arranged around the other end part 61 of the positioning pin 6. Thus the positioning block 51 can be locked in the groove 62 on the other end part 61 of the positioning pin 6.

Figure 5:
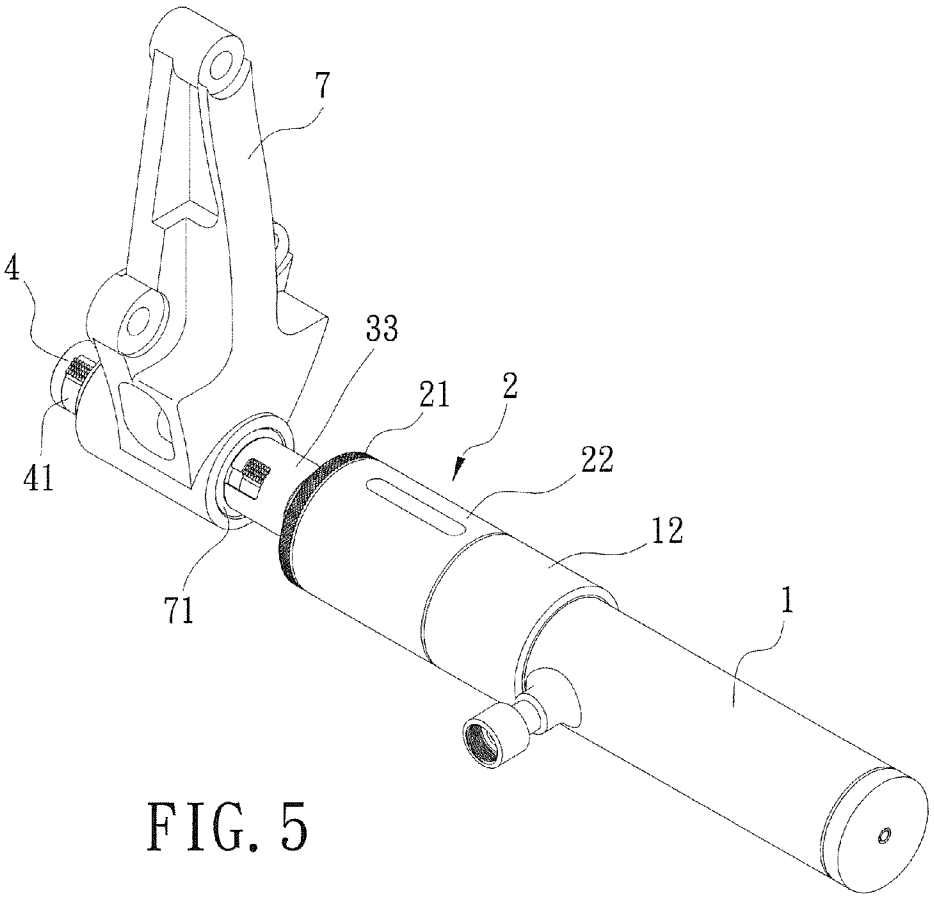
FIG. 5 is a perspective view showing a positioning pin being disassembled of an embodiment according to the present invention.
Figure 6:
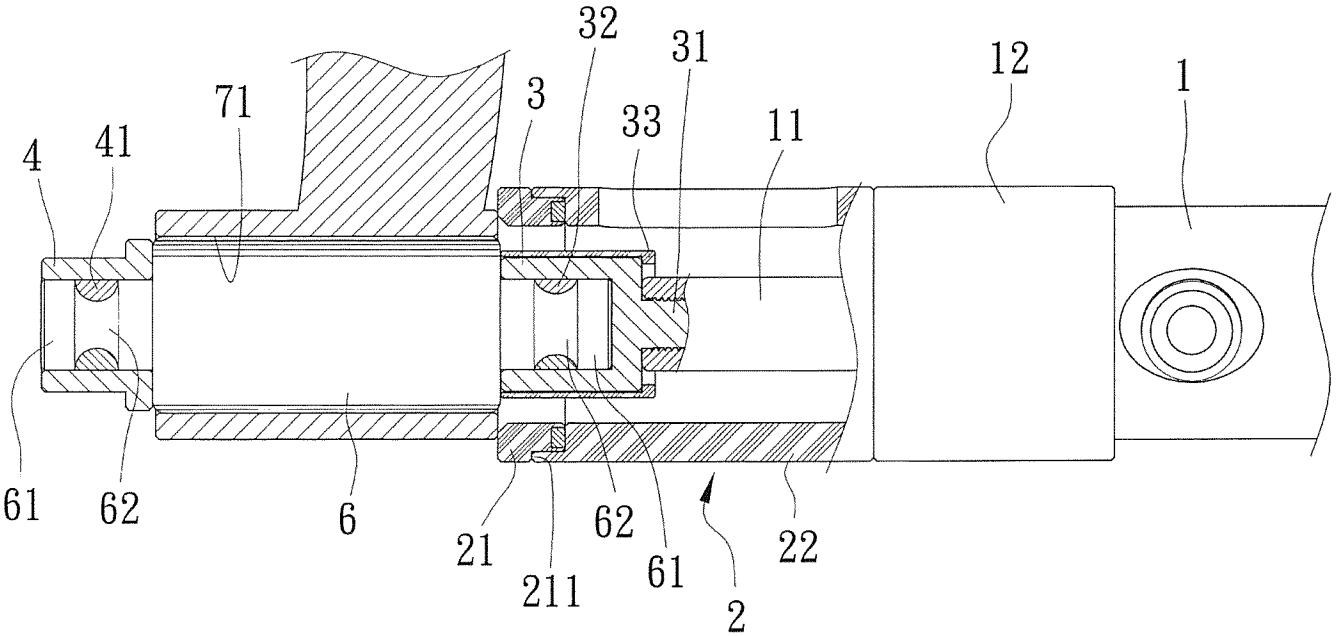
FIG. 6 is a longitudinal sectional view of a positioning pin being disassembled of an embodiment according to the present invention.
Figure 7:
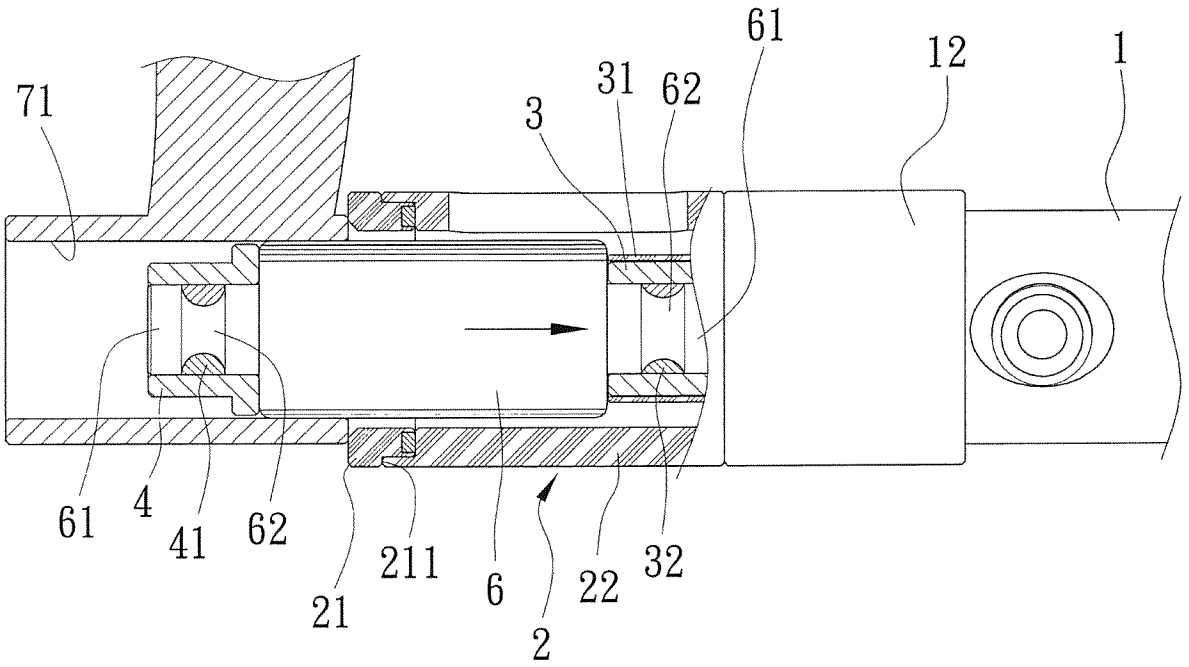
FIG. 7 is a longitudinal sectional view of a positioning pin being moved and disassembled of an embodiment according to the present invention.

Refer to FIG. 5 and FIG. 6, the pin connection unit 3 is fitted over and connected to an end part 61 of a positioning pin 6 and the positioning block 32 is locked in the groove 62 on the end part 61 of the positioning pin 6 while disassembling the positioning pin 6. Then the guiding slot 331 of the binding sleeve 33 is aligned with the positioning protrusion 321 of the positioning block 32. After the pin connection unit 3 and the binding sleeve 33 being mounted and connected to each other, the binding sleeve 33 is rotated so that the positioning protrusion 321 is moved into and positioned by the positioning slot 332. The fixing unit for pin-disassembling 4 is mounted with and connected to the other end part 61 of the positioning pin 6 and the positioning block 41 of the fixing unit for pin-disassembling 4 is locked in the groove 62 on the other end part 61 of the positioning pin 6. The front end of the support base 12 of the cylinder 1 is mounted into the auxiliary support sleeve 22 of the support member 2 and a front end of the auxiliary support sleeve 22 is connected to the support ring 21. An outer end surface of a corresponding assembly hole 71 of an assembly seat 7 is against and supported by the support ring 21. At the moment, the cylinder 1 is driven to move the actuating rod 11 outwards and the actuating rod 11 pulls the positioning pin 6 by the pin connection unit 3. Therefore the positioning pin 6 is pulled out of the assembly hole 71 of the assembly seat 7, as shown in FIG. 7.

Figure 9:
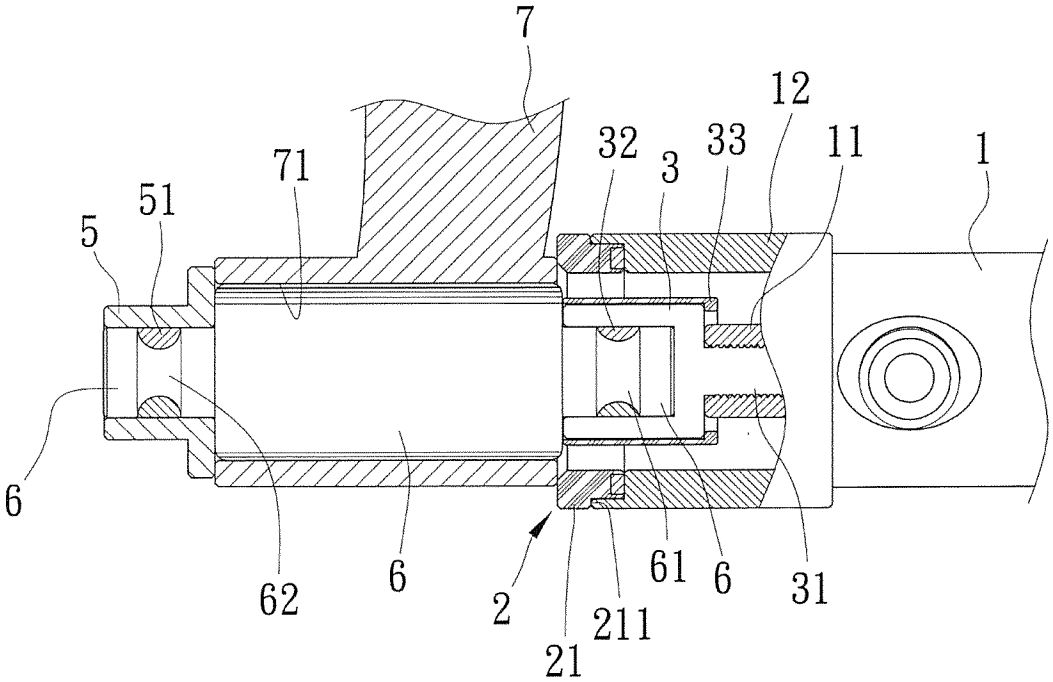
FIG. 9 is a longitudinal sectional view of a positioning pin being assembled of an embodiment according to the present invention.

Refer to FIG. 8, while assembling the positioning pin 6, the actuating rod 11 of the cylinder 1 together with the pin connection unit 3 is passed through the assembly hole 71 of the assembly seat 7. Then the pin connection unit 3 is fitted over and connected to the end part 61 of the positioning pin 6. And the positioning block 32 is locked in the groove 62 on the end part 61 of the positioning pin 6. Next the guiding slot 331 of the binding sleeve 33 is corresponding to the positioning protrusion 321 of the positioning block 32. After the pin connection unit 3 and the binding sleeve 33 being mounted and connected to each other, the binding sleeve 33 is rotated so that the protrusion 321 is moved into and positioned by the positioning slot 332. The fixing unit for pin-assembling 5 is mounted in and connected to the other end part 61 of the positioning pin 6. Then the positioning block 51 of the fixing unit for pin-assembling 5 is locked in the groove 62 on the other end part 61 of the positioning pin 6. The front end of the support base 12 of the cylinder 1 is mounted into the support ring 21 of the support member 2 while the support ring 21 is against the assembly hole 71 of the assembly seat 7. Now the cylinder 1 is driven to move the actuating rod 11 and the actuating rod 11 pulls the positioning pin 6 to move toward the assembly hole 71 of the assembly seat 7 by the pin connection unit 3. Thus the positioning pin 6 is pulled into the assembly hole 71 of the assembly seat 7. The outer diameter of the fixing unit for pin-assembling 5 is larger than the outer diameter of the positioning pin 6 so that the fixing unit for pin-assembling 5 is unable to be pulled into the assembly hole 71 of the assembly seat 7. The fixing unit for pin-assembling 5 is against and stopped by the outer end of the assembly hole 71 of the assembly seat 7. Thus the assembly of the positioning pin 6 is completed, as shown in FIG. 9.

In summary, the present invention has the following advantages compared with the structure available now:

1. The whole structure of the present invention is simpler than that of the conventional one. Thus not only the manufacturing cost is effectively reduced, the assembly and the use of the pin puller are getting easier and more convenient.
2. The cylinder of the present invention is mounted with the actuating rod therein. The pin connection unit is driven by the actuating rod and the positioning pin is further pulled by the pin connection unit. The present invention is simpler and more convenient in operation and use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A pin puller includes a cylinder, a support member, a pin connection unit and a fixing unit for pin-disassembling;

wherein the cylinder is mounted with an actuating rod therein while a support base is connected to a front end of the cylinder and is fitted over the actuating rod;

wherein the support member is connected to the support base of the cylinder and having a support ring and an auxiliary support sleeve; the auxiliary support sleeve is arranged between the support ring and the support base; the auxiliary support sleeve is connected to a front end of the support base and then the support ring is mounted to a front end of the auxiliary support sleeve;

wherein the pin connection unit is connected to and fixed on a front end of the actuating rod of the cylinder, fitted over and connected to an end part of a positioning pin and having a positioning block and a binding sleeve; the positioning block is pivotally connected to the pin connection unit and corresponds to a groove that is concavely disposed around the end part of the positioning pin while the binding sleeve is movably fitted over the actuating rod of the cylinder and disposed around the pin connection unit;

wherein the fixing unit for pin-disassembling has an outer diameter that is smaller than an outer diameter of the positioning pin; the fixing unit for pin-disassembling is mounted with and connected to the other end part of the positioning pin; a positioning block is pivotally connected to the fixing unit for pin-disassembling and corresponds to a groove which is concavely disposed around the other end part of the positioning pin; the positioning block of the fixing unit for pin-disassembling is locked in the groove on the other end part of the positioning pin.

2. The device as claimed in claim 1, wherein one end of the support ring of the support member is disposed with a stepped edge while another stepped edge is formed on one end of the auxiliary support sleeve; the auxiliary support sleeve is connected to the front end of the support base by the another stepped edge and then the support ring is mounted to the front end of the auxiliary support sleeve by the stepped edge.

3. The device as claimed in claim 1, wherein the pin connection unit is disposed with a threaded part that is connected to and fixed on the front end of the actuating rod of the cylinder.

4. The device as claimed in claim 1, wherein a positioning protrusion is projecting from a surface of the positioning block of the pin connection unit; a guiding slot corresponding to the positioning protrusion of the positioning block is formed on the binding sleeve and a positioning slot is formed on a rear end of the guiding slot; the positioning block of the pin connection unit is passed through the guiding slot and moved into the positioning slot to be positioned.

5. A pin puller includes a cylinder, a support member, a pin connection unit and a fixing unit for pin-assembling;

wherein the cylinder is mounted with an actuating rod therein while a support base is connected to a front end of the cylinder and is fitted over the actuating rod;

wherein the support member is mounted and connected to the support base the cylinder; the support member is arranged with a support ring while the support ring is directly mounted to a front end of the support base;

wherein the pin connection unit is connected to and fixed on a front end of the actuating rod of the cylinder, fitted over and connected to an end part of a positioning pin and having a positioning block and a binding sleeve; the positioning block is pivotally connected to the pin connection unit and corresponds to a groove that is concavely disposed around the end part of the positioning pin while the binding sleeve is movably fitted over the actuating rod of the cylinder and disposed around the pin connection unit;

wherein the fixing unit for pin-assembling has an outer diameter that is larger than an outer diameter of the positioning pin; the fixing unit for pin-assembling is fitted over and connected to the other end part of the positioning pin; a positioning block is pivotally connected to the fixing unit for pin-assembling and corresponds to a groove which is concavely arranged around the other end part of the positioning pin; the positioning block of the fixing unit for pin-assembling is locked in the groove on the other end part of the positioning pin.

6. The device as claimed in claim 5, wherein one end of the support ring of the support member is disposed with a stepped edge and the support ring is mounted to the front end of the support base by the stepped edge.

7. The device as claimed in claim 5, wherein the pin connection unit is disposed with a threaded part that is connected to and fixed on the front end of the actuating rod of the cylinder.

8. The device as claimed in claim 5, wherein a positioning protrusion is projecting from a surface of the positioning block of the pin connection unit; a guiding slot corresponding to the positioning protrusion of the positioning block is formed on the binding sleeve and a positioning slot is formed on a rear end of the guiding slot; the positioning block of the pin connection unit is passed through the guiding slot and moved into the positioning slot to be positioned.

* * * * *